US009163650B2

(12) United States Patent
Crowder

(10) Patent No.: US 9,163,650 B2
(45) Date of Patent: Oct. 20, 2015

(54) FLUID PRESSURE ACTUATING MECHANISM WITH MECHANICAL LOCK

(76) Inventor: Kenneth Lee Crowder, Marina del Rey, CA (US)

( * ) Notice: Subject to any disclaimer, the term of this patent is extended or adjusted under 35 U.S.C. 154(b) by 341 days.

(21) Appl. No.: 13/543,465

(22) Filed: Jul. 6, 2012

(65) Prior Publication Data

US 2013/0025447 A1 Jan. 31, 2013

Related U.S. Application Data

(60) Provisional application No. 61/506,617, filed on Jul. 11, 2011.

(51) Int. Cl.
*F15B 15/26* (2006.01)
*B63C 9/04* (2006.01)

(52) U.S. Cl.
CPC *F15B 15/261* (2013.01); *B63C 9/04* (2013.01)

(58) Field of Classification Search
CPC ..... F15B 15/26; F15B 15/261
USPC ..... 92/24, 23, 28
See application file for complete search history.

(56) References Cited

U.S. PATENT DOCUMENTS

| | | | | | |
|---|---|---|---|---|---|
| 2,393,962 | A * | 2/1946 | Ashton et al. | 92/24 |
| 2,815,736 | A * | 12/1957 | Wright | 92/18 |
| 3,107,582 | A * | 10/1963 | Royster | 92/24 |
| 3,581,625 | A * | 6/1971 | Michalak | 91/45 |
| 3,783,745 | A * | 1/1974 | Meijer et al. | 92/83 |
| 4,120,232 | A * | 10/1978 | Hoffman, Jr. | 89/1.51 |
| 4,240,332 | A * | 12/1980 | Deutsch | 92/5 L |
| 4,390,036 | A * | 6/1983 | Athanassiu et al. | 137/116.5 |
| 4,424,738 | A * | 1/1984 | Leighton | 91/422 |
| 4,635,536 | A * | 1/1987 | Liu et al. | 92/24 |
| 4,815,295 | A * | 3/1989 | Narum | 60/632 |
| 5,050,484 | A * | 9/1991 | Kamimura | 92/5 L |
| 5,406,879 | A * | 4/1995 | Willacy | 92/24 |
| 5,667,224 | A * | 9/1997 | Streckert et al. | 277/634 |
| 8,567,303 | B2 * | 10/2013 | Ingersoll et al. | 92/98 D |
| 2006/0083640 | A1 * | 4/2006 | Ellens et al. | 417/415 |

* cited by examiner

*Primary Examiner* — Nathaniel Wiehe
*Assistant Examiner* — Dustin T Nguyen

(57) ABSTRACT

The present system provides a mechanism which provides mechanical locking of an apparatus, with fluid pressure-driven unlocking and an actuating force when an intended level of such pressure has been reached. The present system thus mechanically locks an apparatus against premature actuation caused by, for example, shock or vibration, until it is subjected to a level of pressure intended to actuate it. The present system is suitable for incorporation in any apparatus taking advantage of its ability to utilize fluid pressure to remove a mechanical block at an intended level of pressure and impart an actuating force.

1 Claim, 5 Drawing Sheets

FLUID PRESSURE ACTUATING MECHANISM WITH MECHANICAL LOCK

This patent application claims priority to U.S. Provisional patent application 61/506,617 filed on Jul. 11, 2011 which is incorporated by reference herein in its entirety.

BACKGROUND OF THE SYSTEM

1. Field of the System

This system relates to the field of fluid pressure-driven mechanisms.

2. Background Art

There are a number of situations and circumstances which require the locking of an apparatus against movement until the occurrence of an anticipated event or the presentation of a certain condition for which the apparatus is intended and in which there is an available source of force (for example, atmospheric or hydrostatic pressure) which may be employed to unlock and actuate the apparatus. For example, it may be necessary to lock a triggering mechanism in an automatic flotation device, or in an automatic release mechanism for lifeboats, liferafts, or emergency position indicating radio beacons, against inadvertent actuation due to shock or vibration while not in the water until the device is immersed in water, or until it is immersed to an intended depth, or until a triggering event or circumstance has occurred. Similarly, it may be necessary to lock a triggering mechanism in an automatic parachute opening device against inadvertent actuation due to shock or vibration until the device reaches an intended altitude, or until a triggering event or circumstance has occurred. Such locking may be provided by the presence of a mechanical block against movement of an actuating member of such triggering mechanisms. Such a mechanical block must be subsequently removed to enable actuation of such triggering mechanisms.

SUMMARY OF THE SYSTEM

The present system provides a mechanism which provides mechanical locking of an apparatus, with fluid pressure-driven unlocking and an actuating force when an intended level of such pressure has been reached. The present system thus mechanically locks an apparatus against premature actuation caused by, for example, shock or vibration, until it is subjected to a level of pressure intended to actuate it. The present system is suitable for incorporation in any apparatus taking advantage of its ability to utilize fluid pressure to remove a mechanical block and provide an actuating force at an intended level of pressure.

DETAILED DESCRIPTION OF THE SYSTEM

This system provides a fluid (air, gas, or liquid) pressure actuating mechanism which is mechanically locked against inadvertent actuation until an intended level of fluid pressure unlocks it. Fluid pressure actuating mechanisms which are not mechanically locked may be inadvertently actuated by shock or vibration.

The system utilizes two pressure-responsive diaphragm/piston assemblies which interlock mechanically. One of the diaphragm/piston assemblies performs the locking and unlocking function ("locking assembly") and the other the actuating function ("actuating assembly"). Fluid pressure in the pressure chamber between them acts upon both assemblies, urging each to move away from the other. However, the mechanical lock between them is so configured that the actuating assembly cannot move until the locking assembly has completed its movement away from the actuating assembly. The locking assembly is so configured as to move in response only to fluid pressure, and not to shock or vibration. At the intended level of fluid pressure within the chamber, the locking assembly responds by moving away from the actuating assembly and unlocking it, enabling the actuating assembly to move in response to the fluid pressure and effect the actuating function.

A mechanism which provides mechanical locking of an apparatus, with fluid pressure-driven unlocking of an actuating force when an intended level of such pressure has been reached, is described.

A desirable feature for an actuating mechanism is the ability to prevent actuation at unintended or undesirable times or under unintended or undesirable circumstances. Such inadvertent actuation could be due, for example, to shock or vibration. An effective form of such a feature is one which locks the actuating member or members of an actuating mechanism.

Unlocking an actuating mechanism which has been secured against inadvertent actuation at the intended time or under the intended circumstances is necessary for its correct actuating function. While there can be several means of removing a bias against the movement of the actuating member or members of an actuating mechanism, one such means is the employment of fluid pressure to remove the bias against movement. In the present application, the bias against movement may take many forms. For purposes of example, the bias against movement is discussed herein as a "block" or "lock".

Figure 1:
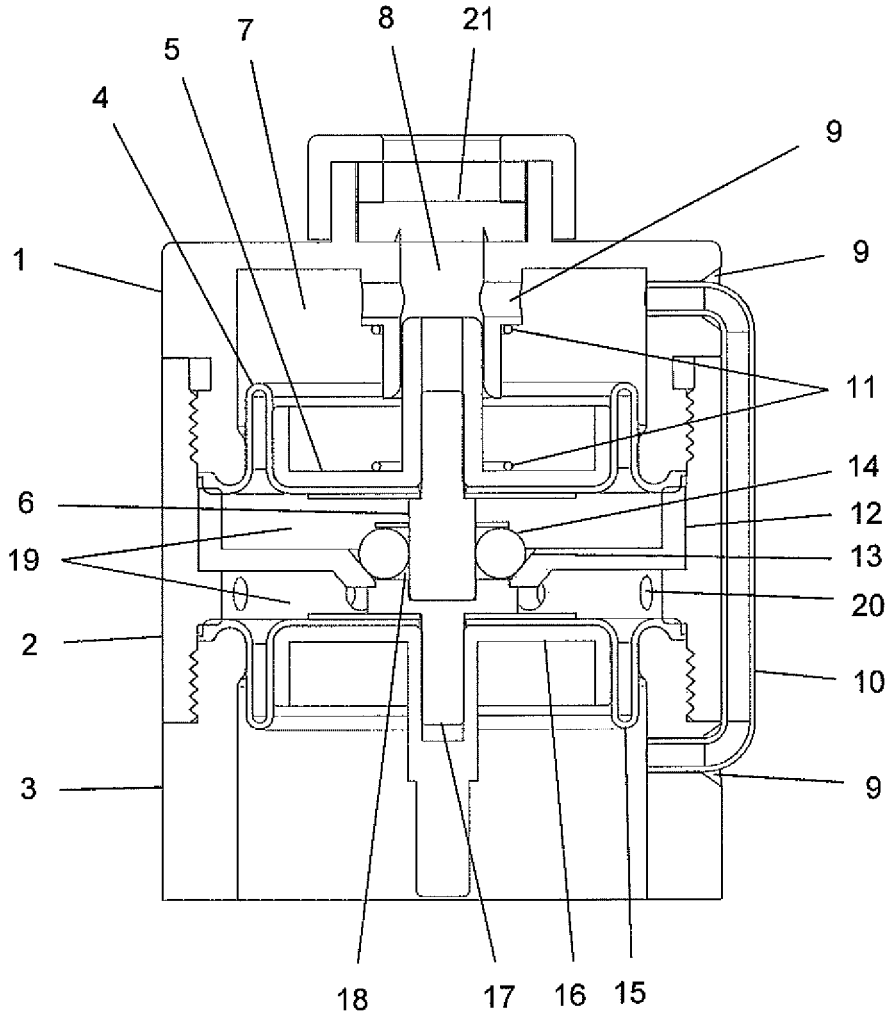
FIG. 1 depicts the apparatus in a locked configuration.

FIG. 1 depicts the apparatus in its locked configuration. The device, which may comprise a locking mechanism body 1 connected by a connecting body 2 to an actuating body 3, may enclose two principal assemblies: (1) a locking, pressure-responsive mechanism ("locking mechanism") which interacts with (2) an actuating, pressure-responsive mechanism ("actuating mechanism") in such manner as to mechanically lock the latter until an intended level of fluid pressure acting upon both mechanisms causes the locking mechanism to mechanically unlock the actuating mechanism and enable it to accomplish its function. In one embodiment, the two assemblies are acted upon by and respond to the same source, type, and level of pressure, with the locking mechanism so configured as to respond to such pressure before the actuating mechanism, thereby unlocking the actuating mechanism and enabling it to respond to such pressure.

Locking Mechanism.

The locking mechanism may comprise a locking mechanism body 1, whose inner cavity houses a locking diaphragm 4, a locking piston 5 with boss 6, a locking mechanism body cavity 7 behind the locking piston and locking diaphragm, a locking piston shaft cavity 8 in the locking mechanism body 1 in which the shaft of the locking piston 5 locates and travels, pressure relief ports 9 in the locking piston shaft cavity 8, the connecting body 2, and the actuating mechanism body 3, pressure relief tubing 10 or other suitable means for the movement of air out of the locking mechanism body cavity 7, a locking piston spring 11, an angled surface 13 on a locking interface 12, and piston locks 14 which are located in an interface created by the outer surface of the boss 6 of the locking piston 5, the angled surface 13 of the locking interface 12, and the walls of cutouts 18 in a hollow boss 17 of an actuating piston 16. A hydrophobic vent 21 of appropriate pore size is sealed into the case wall of the apparatus, allowing passage of air at a slow rate between the interior and exterior of the apparatus, thereby equalizing air pressure when the system is not in the water, while preventing water entry upon immersion.

Actuating Mechanism.

The actuating mechanism may comprise an actuating mechanism body 3 whose inner cavity houses an actuating diaphragm 15 and an actuating piston 16, whose cutouts 18 in its hollow boss 17 participate in an interface with the boss 6 of the locking piston 5 and the angled surface 13 of the locking interface 12. The actuating mechanism may initiate its actuating function by movement in any desired direction intended to initiate another function. In the embodiment described, the actuating direction is away from the locking mechanism.

In the embodiment described, the locking diaphragm and locking piston, and the actuating diaphragm and actuating piston, face each other in an opposed configuration across a pressure chamber 19 created by those opposed diaphragms and the inner wall of the connecting body 2, which is open through entry ports 20 to the entry of an intended pressure medium, including, but not limited to, air or water. The locking mechanism and the actuating mechanism are each hermetically sealed behind their diaphragms, opposite the pressure chamber 19, to enable the creation of a differential pressure across each diaphragm and adjacent piston. Such differential pressure ultimately unlocks the actuating mechanism by imparting movement, first to the locking piston in the direction away from the actuating piston (unlocking direction), and then to the actuating piston in the direction away from the locking piston (actuating direction).

Locking Function.

The interface described above mechanically locks the actuating piston against travel in the actuating direction. In the locked configuration, the piston locks 14 positioned within the cutouts 18 in the wall of the hollow boss 17 of the actuating piston 16 are in contact with the outer surface of the locking piston boss 6, the walls of the cutouts 18, and the angled surface 13 of the locking interface 12, creating a mechanical block against movement of the actuating piston 16 in the actuating direction.

The piston locks 14 may be implemented as bearings, spheres, pins, blocks, cylinders, truncated pyramids, or any other suitable element, and may roll, or slide, or both, along the outer surface of the locking piston boss 6.

Unlocking and Actuating Function.

The sequential unlocking and actuating functions are initiated by the introduction into the pressure chamber of pressure at any intended level which is sufficient to move the locking piston 5 in the unlocking direction, and then the actuating piston 16 in the actuating direction. The intended pressure at which movement of the locking piston 5 is initiated may be selected in any manner which can affect initiation of movement of the piston, including, but not limited to, selection of the coefficient of friction of the rolling and/or sliding piston locks 14, the coefficient of friction of the surface of the locking piston boss 6, the surface area of the locking diaphragm 4, the angle of the locking interface angled surface 13, and the rate of the locking piston spring 11. For example, the locking piston 5 may be biased against movement in the unlocking direction by the locking piston spring 11, whose rate may be selected to cause it to yield at a selected pressure in the pressure chamber 19, thereby initiating the unlocking sequence at an intended depth (hydrostatic pressure) or altitude (atmospheric pressure).

During the initial unlocking process, the pressure relief ports 9 in the locking piston shaft cavity 8 and the locking mechanism body 1 enable the movement of air from behind the locking piston 5 through the pressure relief tubing 10 (or any other appropriate means) to any other area in the apparatus which will relieve the pressure behind the locking piston 5 without reducing to an ineffective level the differential pressure acting on that piston, including into the actuating body 3, thereby reducing the resistance to movement of the locking piston 5 otherwise caused by compression of the air behind it, thereby, further, enabling utilization of a smaller locking body cavity than otherwise possible.

Figure 2:
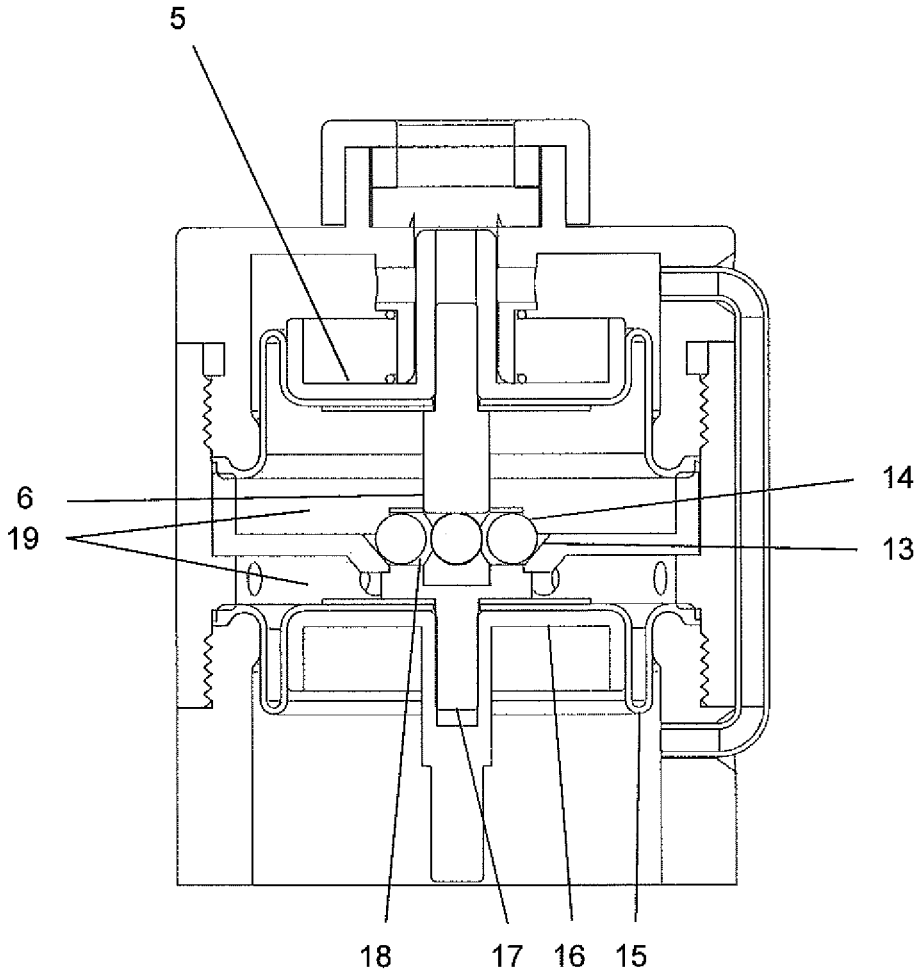
FIG. 2 depicts the apparatus in an initially unlocked configuration.

FIG. 2 depicts the apparatus in an initially unlocked configuration. At the intended level of pressure within the pressure chamber 19 corresponding to, for example, a selected depth in water in a hydrostatic pressure device employed in a flotation, marking, or retrieval mechanism or in a release mechanism for lifeboats, liferafts, or emergency position indicating radio beacons, or to a selected altitude in an atmospheric pressure device employed in a parachute opening mechanism, the pressure in the pressure chamber 19 has attained the preselected level sufficient to overcome the resistance of the locking piston 5 to movement and to displace the boss 6 of the locking piston sufficiently in the unlocking direction to allow the piston locks 14, urged by the force in the actuating direction applied by the actuating diaphragm 15 in response to the pressure in the pressure chamber 19 through the walls of the cutouts 18 of the actuating piston boss 17 against the locking interface angled surface 13, to move radially inward out of their locking positions and fall in behind the withdrawing locking piston boss 6, thereby ending the mechanical block among the piston locks 14, the walls of the cutouts 18, and the locking interface angled surface 13 and enabling the actuating piston 16 to move in the actuating direction.

Figure 3:
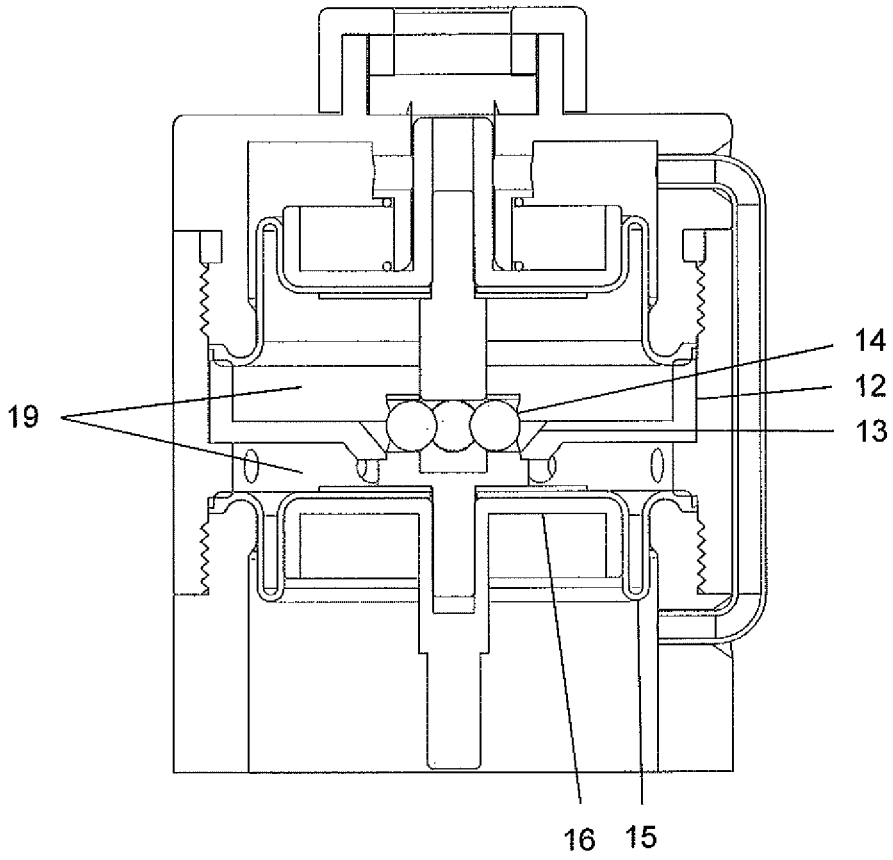
FIG. 3 depicts the apparatus in an unlocked configuration.

FIG. 3 depicts the apparatus in a fully unlocked configuration immediately prior to initial actuation, with the piston locks 14 displaced radially inward and clear of the inner edge of the angled surface 13 of the locking interface 12, thereby freeing the actuating piston 16 to move in the actuating direction as urged by the force in the actuating direction applied by the actuating diaphragm 15 in response to the pressure in the pressure chamber 19.

Figure 4:
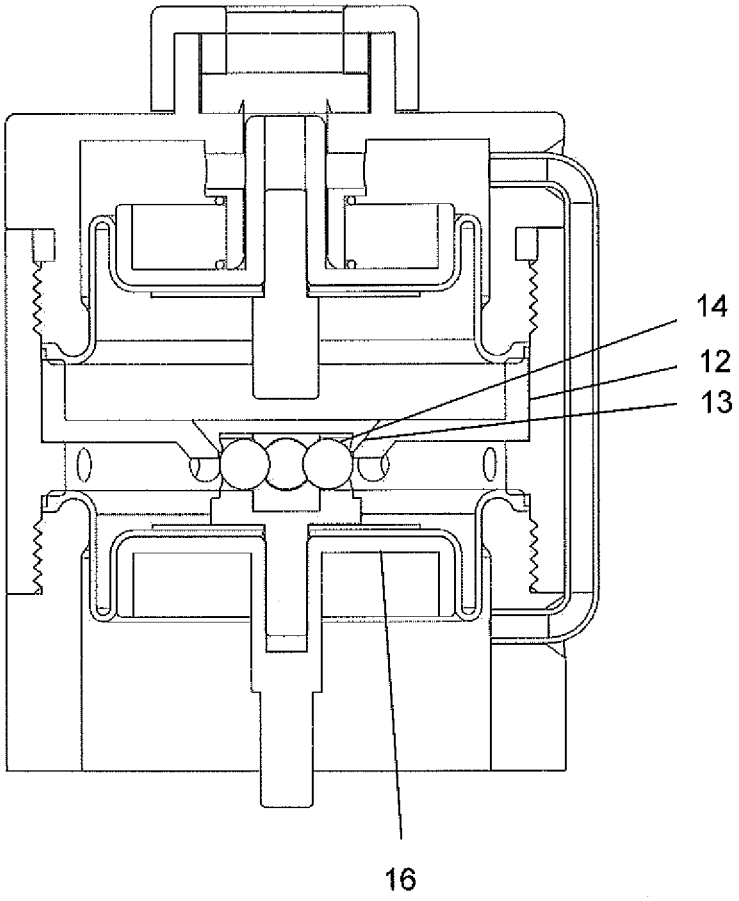
FIG. 4 depicts the apparatus in an unlocked and initially actuated configuration.

FIG. 4 depicts the apparatus in a fully unlocked and initially actuated configuration, with the piston locks 14 clear of the inner edge of the angled surface 13 of the locking interface 12 and the actuating piston 16 beginning movement in the actuating direction.

Figure 5:
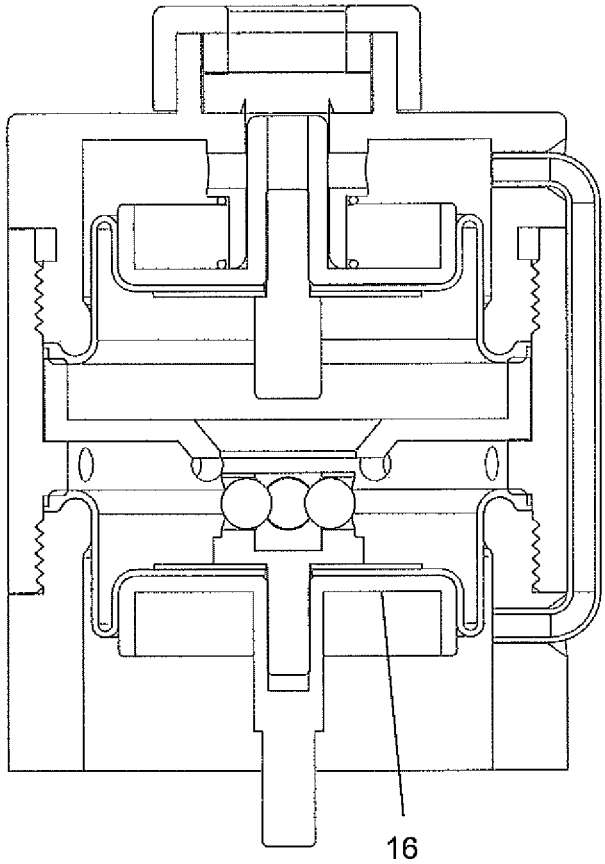
FIG. 5 depicts the apparatus in an unlocked and actuated configuration.

FIG. 5 depicts the apparatus in a fully unlocked configuration, with the actuating piston 16 fully displaced in the actuating direction.

Thus, a mechanical locking with fluid pressure unlocking and actuating mechanism has been described.

I claim:

1. An apparatus comprising:

a cylinder containing a locking piston incorporating a first boss at its head which mechanically locks an actuating piston incorporating at its head a hollow boss receiving said first boss and incorporating cutouts accommodating radial movement therein of piston locks, said piston locks released to move radially inward by the withdrawal of said first boss when an intended level of fluid pressure acts upon said locking piston, unlocking said actuating piston to impart an actuating force;

and wherein a pressure relief passageway connects the cylinder cavity behind said locking piston to the cylinder cavity behind said actuating piston;

and wherein a hydrophobic mechanism seals the interior of the apparatus against liquid entry while allowing the equalization of external air pressure and the internal air pressure on both sides of both said pistons.

* * * * *